US009246235B2

(12) United States Patent
Smith et al.

(10) Patent No.: US 9,246,235 B2
(45) Date of Patent: Jan. 26, 2016

(54) CONTROLLABLE DIRECTIONAL ANTENNA APPARATUS AND METHOD

(71) Applicant: Ericsson Canada, Ottawa (CA)

(72) Inventors: Roland Smith, Nepean (CA); Peter Frank, Stittsville (CA); Jim Wight, Ottawa (CA)

(73) Assignee: Telefonaktiebolaget L M Ericsson, Stockholm (SE)

( * ) Notice: Subject to any disclaimer, the term of this patent is extended or adjusted under 35 U.S.C. 154(b) by 224 days.

(21) Appl. No.: 13/661,373

(22) Filed: Oct. 26, 2012

(65) Prior Publication Data

US 2014/0118191 A1 May 1, 2014

(51) Int. Cl.

| | |
|---|---|
| ***H01Q 19/30*** | (2006.01) |
| ***H01Q 21/00*** | (2006.01) |
| ***H01Q 15/20*** | (2006.01) |
| ***H01Q 3/24*** | (2006.01) |
| *H01Q 1/22* | (2006.01) |
| *H01Q 1/38* | (2006.01) |
| *H01Q 3/44* | (2006.01) |
| *H01Q 21/24* | (2006.01) |

(52) U.S. Cl.

CPC ..... *H01Q 19/30* (2013.01); *H01Q 3/242* (2013.01); *H01Q 1/2291* (2013.01); *H01Q 1/38* (2013.01); *H01Q 3/446* (2013.01); *H01Q 21/24* (2013.01)

(58) Field of Classification Search

USPC ..... 343/819, 817, 818, 915

See application file for complete search history.

(56) References Cited

U.S. PATENT DOCUMENTS

| | | | |
|---|---|---|---|
| 2,749,544 | A | 6/1956 | Pike |
| 4,700,197 | A | 10/1987 | Milne |

(Continued)

FOREIGN PATENT DOCUMENTS

| | | | |
|---|---|---|---|
| CA | 2 596 025 | A1 | 4/2008 |
| CN | 202662775 | U | 1/2013 |

(Continued)

OTHER PUBLICATIONS

Transmittal; International Search Report; and Written Opinion of the International Searching Authority for International Application No. PCT/IB2013/002384 with a mailing date of Apr. 9, 2014.

(Continued)

*Primary Examiner* — Graham Smith

(74) *Attorney, Agent, or Firm* — Katten Muchin Rosenman LLP

(57) ABSTRACT

Controllable directional antenna apparatus and method preferably includes structure and/or steps whereby a Yagi antenna array has a first driven element, a first reflector, and plurality of first directors disposed on a common substrate. The first reflector is bent such that (i) an unbent length thereof is longer than a length of the first driven element, but (ii) a bent length thereof is shorter than the length of the first driven element. A second driven element is also disposed on the common substrate but is angled with respect to the first driven element. A second reflector and a plurality of second directors are also disposed on the common substrate. The second reflector is bent like the first reflector, to reduce the footprint of the array on the substrate. Preferably, the Yagi antenna elements are printed on a printed circuit board.

21 Claims, 6 Drawing Sheets

(56) References Cited

U.S. PATENT DOCUMENTS

| | | | | |
|---|---|---|---|---|
| 5,767,809 | A | 6/1998 | Chuang et al. | |
| 6,326,922 | B1 | 12/2001 | Hegendoerfer | |
| 7,602,340 | B2 | 10/2009 | Sato | |
| 7,973,714 | B2 | 7/2011 | Lee | |
| 8,059,031 | B2 | 11/2011 | Lee | |
| 2003/0231138 | A1 | 12/2003 | Weinstein | |
| 2007/0069968 | A1 | 3/2007 | Moller et al. | |
| 2009/0174557 | A1 | 7/2009 | Nikitin et al. | |
| 2010/0119002 | A1 | 5/2010 | Hartenstein | |
| 2011/0063181 | A1* | 3/2011 | Walker | 343/803 |

FOREIGN PATENT DOCUMENTS

| | | | |
|---|---|---|---|
| EP | 1 517 398 | A1 | 3/2005 |
| JP | 2009-231926 | A | 10/2009 |
| JP | 2010-016460 | A | 1/2010 |

OTHER PUBLICATIONS

Andrew W. Ganse, "Introduction to beamforming", Applied Physics Laboratory, University of Washington, retrieved from <http://staff.washington.edu/aganse/beamforming/beamforming.htm.> on Apr. 26, 2013, last modified on Nov. 13, 2006.

P. K. Varlamos and C. N. Capsalis, "Electronic Beam Steering Using Switched Parasitic Smart Antenna Arrays", Progress in Electromagnetics Research, PIER 36, 101-119, 2002.

Transmittal; International Search Report; and the Written Opinion of the International Searching Authority for International Application No. PCT/IB2014/060408 with a mailing date of Jul. 23, 2014.

* cited by examiner

CONTROLLABLE DIRECTIONAL ANTENNA APPARATUS AND METHOD

BACKGROUND OF THE INVENTION

1. Field of the Invention

The present invention relates to wireless communication and smart antennas. More specifically, the present invention relates to smart antennas for wireless local area network ("WLAN"), Wi-Fi, and pico-cellular wireless communications systems, including IEEE 802.11 systems. In particular, the present invention provides an innovative Yagi antenna array, which is controllable, and has particular utility as a wired, controllable antenna array for multiple-input and multiple-output (MIMO) telecommunications systems.

2. Description of the Related Art

As is known, a Yagi antenna is a directional antenna having a driven element (typically a dipole or folded dipole) and additional parasitic elements (usually a reflector and one or more directors). The Yagi design operates on the basis of electromagnetic interaction between the parasitic elements and the driven element. The reflector element is typically slightly longer than the driven element, whereas the directors are typically somewhat shorter. This design achieves a substantial increase in the antenna's directionality and gain compared to a simple dipole. See for example U.S. Pat. No. 6,326,922, incorporated herein by reference. Such Yagi antennas are often referred to as beam antennas due to their high gain over a narrow bandwidth, making them useful in various telecommunications systems. However, the beam is fixed due to the linear geometry of the driven element, the reflector, and the director(s).

Means for switching the directionality of Yagi antennas is disclosed in U.S. Pat. No. 7,602,340, incorporated herein by reference. FIG. 46 depicts a structure by which the antenna beam can be switched by 180 degrees. When a positive voltage is applied to the parasitic elements 101, one of them is brought into conduction with the auxiliary elements 103 provided at the respective ends thereof, to thus act as a reflector. The remaining parasitic element 101 is not brought into conduction with the auxiliary elements 103, to thus act as a director. Therefore, the antenna exhibits directivity in the direction of the parasitic element 101 that remains out of conduction with the auxiliary elements 103. When a positive voltage is applied to the parasitic elements 101, the opposite occurs and the beam is switched by 180 degrees. In FIGS. 1 and 2, the first ground conductor 5 and the parasitic element 6 are provided co-planar with the radiating element 3. The switches 7 are short-circuited by means of a control signal output from the control circuit 10, to bring the first ground conductor 5 and the parasitic element 6 into electrical conduction with each other. That is, the radiating element 3 is enclosed by the ground conductor, as shown in (2) of FIG. 2(*a*). As shown in (2) of FIG. 2(*b*), the antenna thus exhibits directivity where the maximum radiation arises in directions ±Z. However, when the switches 7 are opened by the control signal output from the control circuit 10; i.e., when a portion surrounding the radiating element 3 is separated from the ground conductor as shown in (3) of FIG. 2(*a*), the parasitic element 6 acts as a director. As shown in (3) of FIG. 2(*b*), the antenna becomes unidirectional and exhibits the maximum radiation in a direction +X. Thus, the directivity of the antenna can be 20 switched through about 90 degrees by means of short-circuiting or opening the switches 7. A problem with these approaches is that complicated switching circuitry is required, and antenna beam steering by only 90 degree increments is achieved.

Another useful antenna array for telecommunications is disclosed in U.S. patent application No. 13/871,394, filed Apr. 26, 2013 for "MULTI-BEAM SMART ANTENNA FOR WLAN AND PICO CELLULAR APPLICATIONS", also incorporated herein by reference.

With the proliferation of wireless local area networks or WLANs, there has been an increase in requirements to find cost effective means to deploy small, efficient access points having MIMO capabilities. In such systems, plural differently-oriented Yagi antennas would enable multi-directional coverage, but would require very many Yagi antennas to cover a wide (e.g., 360 degree) field. Additionally, since each reflector is longer than the driven element, such a multi-Yagi array would have a very large footprint.

The present invention provides method and apparatus to enable a Yagi antenna array to compress the side(s) of reflectors, so that multiple Yagi antennas can be compactly integrated into a single array of elements. The present invention additionally improves the bandwidth of the antenna to enable good return loss across the entire 5 GHz band. Further, the present invention provides unique Yagi and non-Yagi antenna arrays.

SUMMARY OF THE INVENTION

In one aspect, the invention provides a Yagi antenna array, having a first driven element disposed on a first substrate, and a first reflector also disposed on the first substrate on one side of the first driven element. The first reflector is bent such that an unbent length of the first reflector is longer than a length of the first driven element, but a bent length of the first reflector is shorter than the length of the first driven element. A plurality of first directors is disposed on the first substrate on a side of the first driven element which is opposite a side on which the first reflector is disposed. A second driven element is also disposed on the first substrate and (i) co-planar but (ii) non-linear, with respect to the first driven element. A second reflector is disposed on the first substrate on one side of the second driven element. The second reflector is bent such that an unbent length of the second reflector is longer than a length of the second driven element, but a bent length of the second reflector is shorter than the length of the second driven element. A plurality of second directors is disposed on the first substrate on a side of the second driven element which is opposite a side on which the second reflector is disposed.

Preferably, a third driven element is disposed on a second substrate which is orthogonally disposed with respect to the first substrate, and a third reflector is disposed on the second substrate on one side of the third driven element. The third reflector is bent such that an unbent length of the third reflector is longer than a length of the third driven element, but a bent length of the third reflector is shorter than the length of the third driven element. A plurality of third directors is disposed on the second substrate on a side of said third driven element which is opposite a side on which the third reflector is disposed. A fourth driven element is disposed on a third substrate which is orthogonally disposed with respect to the first substrate at an angle with respect to the second substrate. A fourth reflector is disposed on the third substrate on one side of the fourth driven element. The fourth reflector is bent such that an unbent length of the fourth reflector is longer than a length of the fourth driven element, but a bent length of the fourth reflector is shorter than the length of the fourth driven element. A plurality of fourth directors is disposed on the third substrate on a side of the fourth driven element which is opposite a side on which the fourth reflector is disposed.

In another aspect, the invention provides a printed Yagi antenna array having a horizontal printed circuit board substrate. First, second, third, fourth, fifth, and sixth Yagi antennas are printed on the horizontal substrate, each Yagi antenna oriented with respect to its neighboring Yagi antennas such that their respective beams diverge in a range of about 30 degrees to about 60 degrees. Each Yagi antenna has a driven element, a reflector, and a plurality of directors. The reflector is bent such that an unbent length of the reflector is longer than a length of the driven element, but a bent length of the reflector is shorter than the length of the driven element.

In yet another aspect, the invention provides a method of switching antenna beams in a circularly-oriented, six Yagi antenna array disposed on a printed circuit board, each Yagi antenna having a driven element, a reflector, and plural directors. A control circuit is operated so as to activate a first driven element to cause a first beam to be (i) reflected by a first reflector having an unbent length which is longer than a length of the first driven element, but a bent length of which is shorter than the length of the first driven element, and (ii) directed by plural first directors in a first direction. The control circuit is operated so as to inactivate the first driven element. The control circuit is further operated so as to activate a second driven element to cause a second beam to be (i) reflected by a second reflector having an unbent length which is longer than a length of the second driven element, but a bent length of which is shorter than the length of the second driven element, and (ii) directed by plural second directors in a second direction which is at least 30 degrees divergent from the first direction.

The means of wired connectivity coupled into the module may be selected from the group consisting of DOCSIS, DSL, ADSL, HDSL, VDSL, EPON, GPON, Optical Ethernet, T1, and E1. The at least one antenna element may be configured to enable wide-band multi-carrier operation. The at least one wireless transceiver may include a plurality of wireless transceivers, and the at least one antenna element may include a plurality of antenna elements, each of the plurality of antenna elements corresponding to a different one of the plurality of wireless transceivers.

DETAILED DESCRIPTION OF THE INVENTION

Figure 1:
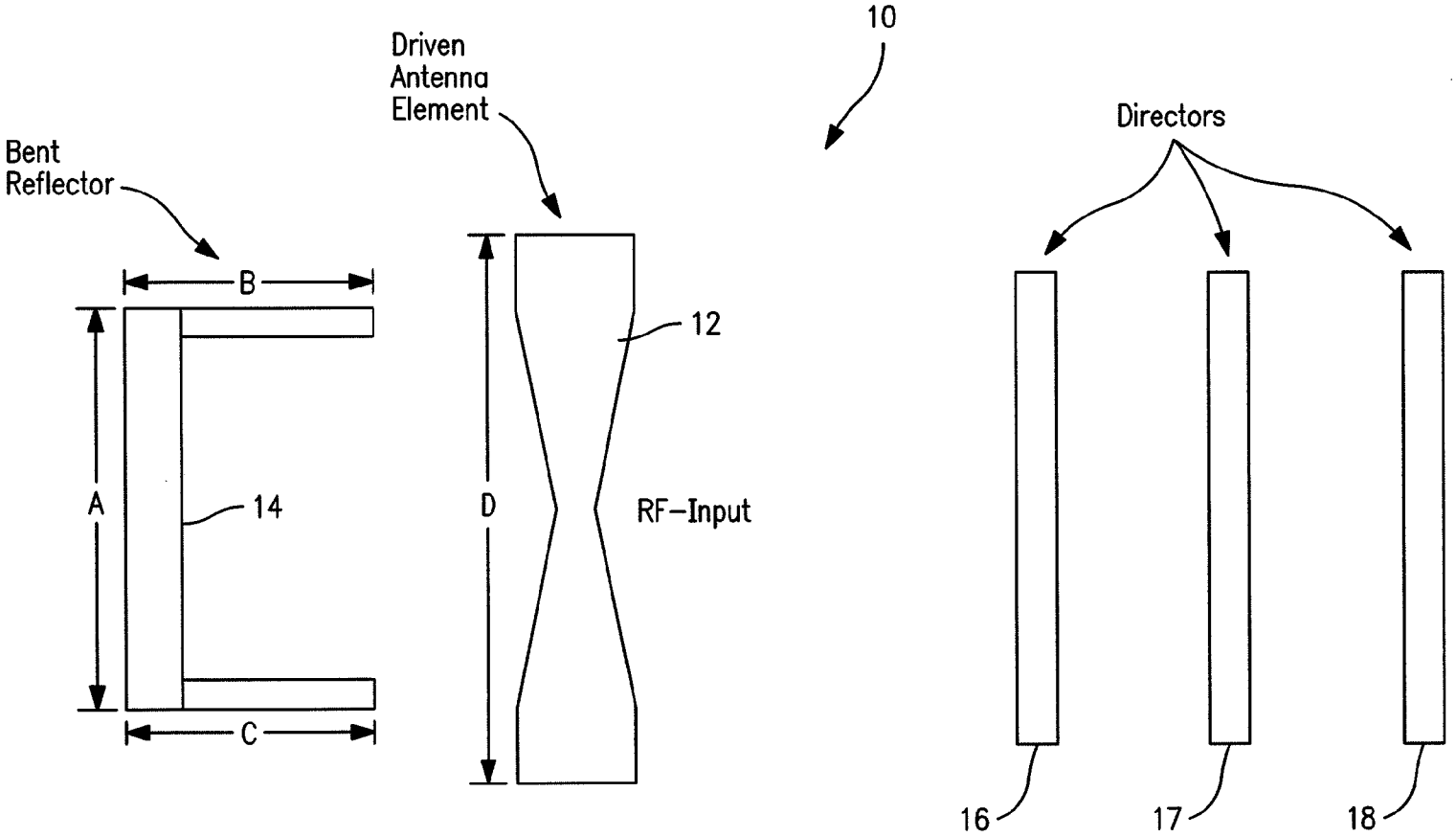
FIG. 1 is a schematic top view of a Yagi antenna according to a preferred embodiment.

Preferred embodiments of the present invention will be described hereinbelow with reference to the accompanying drawings. In the following description, well-known functions or constructions are not described in detail because they may obscure the invention in unnecessary detail. The present invention relates to an innovative smart antenna system that may be coupled to, or integrated with, an Access Point (AP) or other communication device to enhance Wi-Fi and pico-cellular operation with multiple clients in an interference-limited environment. The present invention may find particular utility in strand-mount APs for Tier One cable operators building small-cell networks. Such APs preferably incorporate dual 802.11n-2009 Wi-Fi radios with 3×3 MIMO and 3 spatial stream support. Each AP preferably integrates a DOCSIS® 3.0, Euro-DOCSIS 3.0, or Japanese-DOCSIS 3.0 cable modem.

For this disclosure, the following terms and definitions shall apply:

The terms "IEEE 802.11" and "802.11" refer to a set of standards for implementing WLAN computer communication in the 2.4, 3.6 and 5 GHz frequency bands, the set of standards being maintained by the IEEE LAN/MAN Standards Committee (IEEE 802).

The terms "communicate" and "communicating" as used herein include both conveying data from a source to a destination, and delivering data to a communications medium, system, channel, network, device, wire, cable, fiber, circuit, and/or link to be conveyed to a destination; the term "communication" as used herein means data so conveyed or delivered. The term "communications" as used herein includes one or more of a communications medium, system, channel, network, device, wire, cable, fiber, circuit, and/or link.

The term "omnidirectional antenna" as used herein means an antenna that radiates radio wave power uniformly in all directions, with the radiated power decreasing with elevation angle above or below the plane, dropping to zero on the antenna's axis, thereby producing a doughnut-shaped radiation pattern.

The terms "directional antenna" and "beam antenna" as used herein mean an antenna that radiates greater power in one or more directions, allowing for increased performance on transmission and reception, and reduced interference from unwanted sources.

The term "processor" as used herein means processing devices, apparatus, programs, circuits, components, systems, and subsystems, whether implemented in hardware, tangibly-embodied software or both, and whether or not programmable. The term "processor" as used herein includes, but is not limited to, one or more computers, hardwired circuits, signal modifying devices and systems, devices, and machines for controlling systems, central processing units, programmable devices, and systems, field-programmable gate arrays, application-specific integrated circuits, systems on a chip, systems comprised of discrete elements and/or circuits, state machines, virtual machines, data processors, processing facilities, and combinations of any of the foregoing.

The terms "storage" and "data storage" and "memory" as used herein mean one or more data storage devices, apparatus, programs, circuits, components, systems, subsystems, locations, and storage media serving to retain data, whether on a temporary or permanent basis, and to provide such retained data. The terms "storage" and "data storage" and "memory" as used herein include, but are not limited to, hard disks, solid state drives, flash memory, DRAM, RAM, ROM, tape cartridges, and any other medium capable of storing computer-readable data.

The term "smart antenna" as used herein means an antenna, or antenna system, that uses one or more techniques to target clients by improving either (i) the signal to interference ratio of the client; or (ii) the signal to noise ratio of the client. Such targeting techniques may include, for example: (i) beamforming; (ii) beam steering. In the case of improving the signal to interference ratio, the technique involves beam switching and beam steering of antenna patterns which are designed to maximize the ratio of the signal (directivity/gain) to the interferers (non-directed side and back lobes). In the case of improving the signal to noise ratio, the same techniques are involved, with the antenna patterns selected to maximize the signal strength to the background noise, and this is largely achieved by maximizing the gain.

Regardless of the targeting technique, smart antennas are, generally speaking, antenna arrays with smart signal-processing algorithms used to identify spatial signal signatures, such as a signal's direction of arrival ("DOA"), and to calculate beamforming vectors to track and locate the antenna beam on the mobile/target. Smart antennas and/or antenna systems are often used to improve Wi-Fi and pico-cellular operation in an interference-limited environment (e.g., an environment with higher levels of interference). Therefore, an objective of such smart antenna systems is to improve the SNR or SNIR (signal to noise and interference ratio) of a signal, thereby increasing effective data communication. As is known in the art, SNR refers to the comparison of the level of a desired signal to the level of background noise, and is defined as the ratio of signal power to the noise power. For example, an SNR value greater than 0 dB indicates that there is more signal than noise. A factor to consider is that SNR issues often arise at an AP, which is especially true for outdoor APs, where the AP is usually located high on a pole or mounted to a wall, thereby being exposed to much higher signal levels, including from interference sources.

Beamforming, a first targeting technique that may be used with 802.11 systems, refers to a method used to create a particular radiation pattern of the antenna array by adding constructively the phases of the signals in the direction of the targets/mobiles desired, and nulling the pattern of the targets/mobiles that are undesired/interfering targets. This may be accomplished using, for instance, a simple finite-impulse response ("FIR") tapped delay line filter. Using this technique, the weights of the FIR filter may also be changed adaptively, and be used to provide optimal beamforming, in the sense that it reduces the minimum mean square error ("MMSE") between the desired and actual beam pattern formed. In essence, using this process, a beam may be formed by modifying the phase and amplitude of the RF signals sent to the antennas. For additional information related to beamforming and beamforming techniques, see, for example, Andy Ganse's articles *An Introduction to Beamforming*, Applied Physics Laboratory, University of Washington, Seattle, available at http://staff.washington.edu/aganse/beamforming/beamforming.htm.

Beam steering, on the other hand, involves changing the direction of the main lobe of a radiation pattern—in effect steering the antenna's direction. Beam steering may be accomplished by switching antenna elements, changing the relative phases of the RF signals driving the elements, and/or using an electrical and/or mechanical means to point to a desired direction. For example, an exemplary beam steering method using parasitic elements is disclosed by P. K. Varlamos and C. N. Capsalis, *Electronic Beam Steering Using Switched Parasitic Smart Antenna Arrays*, Progress In Electromagnetics Research, PIER 36, 101-119, 2002.

An early small linearly polarized adaptive array antenna for communication systems is disclosed by U.S. Pat. No. 4,700,197 to Robert Milne (the "Milne patent"), entitled "Adaptive Array Antenna" (the "Milne antenna"), incorporated herein by reference. As discussed in the Milne patent, the directivity and pointing of the Milne antenna's beam may be controlled electronically in both the azimuth and elevation planes. The Milne patent notes that the Milne antenna was found to have a low RF loss and operated over a relatively large communications bandwidth. As disclosed in the Patent and illustrated in FIG. 1*a*, the Milne antenna 100 consists, essentially, of a driven λ/4 monopole 102 surrounded by an array of coaxial parasitic elements 104, all mounted on a ground plane 106 of finite size. The parasitic elements 104 may be connected to the ground plane 106 via PIN diodes or equivalent switching means. By applying suitable biasing voltage, the desired parasitic elements 104 could be electrically connected to the ground plane 106 and made highly reflective, thereby controlling the radiation pattern of the antenna.

While greatly improved over basic traditional antennas, the Milne antenna is still lacking in a number of ways. For instance, this type of Milne array, which consists of a series of parasitic elements connected to a single side of a ground plane, has a significant elevation tilt upwards from the ground plane and into the sky. While this configuration works well for tracking satellites, it does not work well for tracking Wi-Fi or 4G-cellular clients, which are typically at or near the ground level (e.g., ~zero elevation). The theory of operation for the Milne antenna is described using the coordinate system 100 illustrated in FIG. 1*a*. Ignoring the effects of mutual coupling and blockage between elements and the finite size of the ground plane 106, the total radiated field of the antenna array is given by Equation 1, where θ and ϕ are the angular coordinates of the field point in the elevation and azimuth planes respectively. A(θ, ϕ) is the field radiated by the driven element. K is the complex scattering coefficient of the parasitic element. G(θ, ϕ) is the radiation pattern of the parasitic element. $F_{ij}$ ($r_i$, $\phi_{ij}$, θ, ϕ) is the complex function relating the amplitudes and phases of the driven and parasitic radiated fields. N is the number of rings of parasitic elements. M(i) is the number of parasitic elements in the i ring.

$$E(\theta, \phi) = A(\theta, \phi) + KG(\theta, \phi)\sum_{i=1}^{N}\sum_{j=1}^{M(i)} F_{ij}(r_i, \phi_{ij}, \theta, \phi) \qquad \text{Equation 1}$$

As evidenced in its figures, the Milne patent presents a series of parasitic element profiles, all of which are designed to maximize the theoretical gain of the antenna, or adjust the elevation beam width of the antenna. However, these Milne profiles are designed to address overhead satellites, which typically require a high azimuth gain and elevation adjustment—characteristics that are not ideal for ground level Wi-Fi or 4G-cellular clients. Milne even suggests that a practical embodiment of the invention was designed, built, and field tested for satellite-mobile communications applications at 1.5 GHz. The high azimuth gain and elevation adjustment is shown in FIGS. 1 *b* and 1*c*, which are reproduced from the Milne patent. FIG. 1 *b* illustrates a biasing configuration that generates a "low" elevation beam, while the measured low and high beam radiation patterns at mid-band frequency are shown in FIG. 1 *c*, which illustrates the azimuth radiation patterns at mid-band frequency where the solid line is the low elevation beam measured at a constant elevation angle of 30 degrees and the broken line 40 of the high elevation beam measured at a constant elevation angle of 55 degrees.

The technical area of the subject application is the development of a wired controllable antenna for a MIMO system. It enables the direction of the Yagi (or combined Yagi-Milne) antenna array beam to be switched/controlled so as to be steerable in a 360 degree range. This invention addresses space constraints, and presents novel means of compressing the side of reflector of the Yagi antenna, so that multiple Yagi antennas can be integrated into a single array of elements.

Normally, the reflector is typically longer than the driven element. In order to reduce the size of the reflector, the ends of the reflector can be bent in the direction of the active element. This is useful in a planar array having a plurality of Yagi antennas arranged radially, by reducing the necessary antenna spacing. A plurality of reduced reflector Yagi antennas are disposed on a substrate, all radiating outwards from a centre point but pointing in different azimuth (horizontal plane) directions. Alternatively or additionally, a single driven element may be provided with plural reflectors and/or plural directors FIG. 1 is a schematic top view of a Yagi antenna according to a first embodiment. A Yagi antenna 10 has a driven element 12, a reflector 14, and plural directors 16, 17, and 18. Preferably, these elements are printed on a printed circuit board (PCB) using known techniques. The driven element 12 preferably comprises a butterfly-shaped dipole, but may comprise a rectangular or trapezoidal shape, depending upon the application. Preferably, the dipole is connected to switching circuitry (to be discussed below) for driving the antenna. The reflector 14 is bent to reduce the footprint on the PCB and allow more Yagi antennas to be provided in the array. The bent shape will result in the loss of some gain, but will increase the bandwidth of the antenna beam. FIG. 1 shows a bent rectangular-shaped reflector 14, but other shapes such as square, trapezoidal, curved, rectilinear, or combinations of these may be used, depending on the PCB geometry and the application. Preferably, the reflector 14 has an unbent length (combined lengths A, B, and C in FIG. 1) which is greater than a length D of the driven element 12; but, a bent length (length A in FIG. 1) which is less than the length D of the driven element 12.

The directors 16, 17, and 18 are parasitic elements which improve the gain of the transmitted beam. Preferably, 2-6 directors will provide sufficient gain for the signals used in most MIMO systems. In the most preferred embodiments, two to three directors are used.

Figure 2:
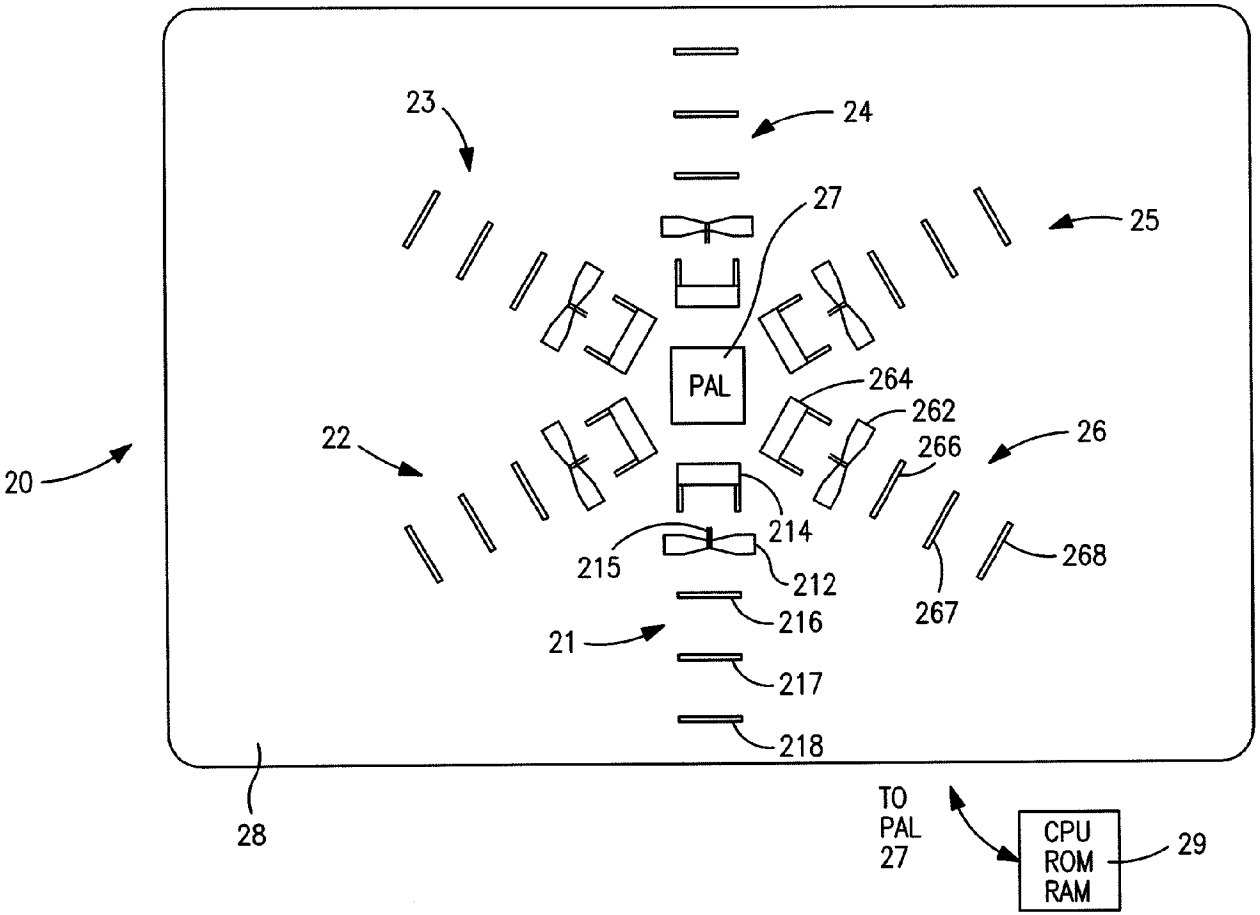
FIG. 2 is a schematic top view of a Yagi antenna array according to a preferred embodiment.

FIG. 2 is a schematic top view of a Yagi antenna array 20 according to a preferred embodiment. The array 20 is preferably printed on substrate 28 to provide the PCB. Yagi antennas 21, 22, 23, 24, 25, and 26 are printed on the top surface of the substrate 28 and are oriented in 60 degree increments about a center of the substrate 28, as shown. Each Yagi antenna has a driven element, a reflector, and plural directors. For example, Yagi antenna 21 has a driven element 212, a bent reflector 214, and three directors 216, 217, and 218. In this embodiment, the Yagi antennas are designed for communications in the 5.0 GHz band. Preferably, the substrate 28 comprises a FR4 woven fiberglass-reinforced, epoxy resin-laminated, high-pressure thermoset printed circuit board. The driven elements, reflectors, and directors preferably comprise copper materials printed or otherwise deposited on the substrate 28. Preferably, each driven element has lead wires or wiring (e.g., 215 for dipole 212) coupled to programmable logic array 27.

The programmable logic array (PAL) 27 is preferably located in the center of the Yagi antennas 21, 22, 23, 24, 25, and 26, and switches the driven elements so as to steer the array beam in 60 degree azimuth increments in a preferably horizontal plane. The PAL 27 preferably has a small PROM (programmable read-only memory) core with additional output logic used to implement the desired switching functions, with few components, and is preferably field-programmable. The PAL 27 is controlled by one or more processors 29, preferably located on another PCB in the housing (to be described below) that controls the telecommunications functions.

Figure 3:
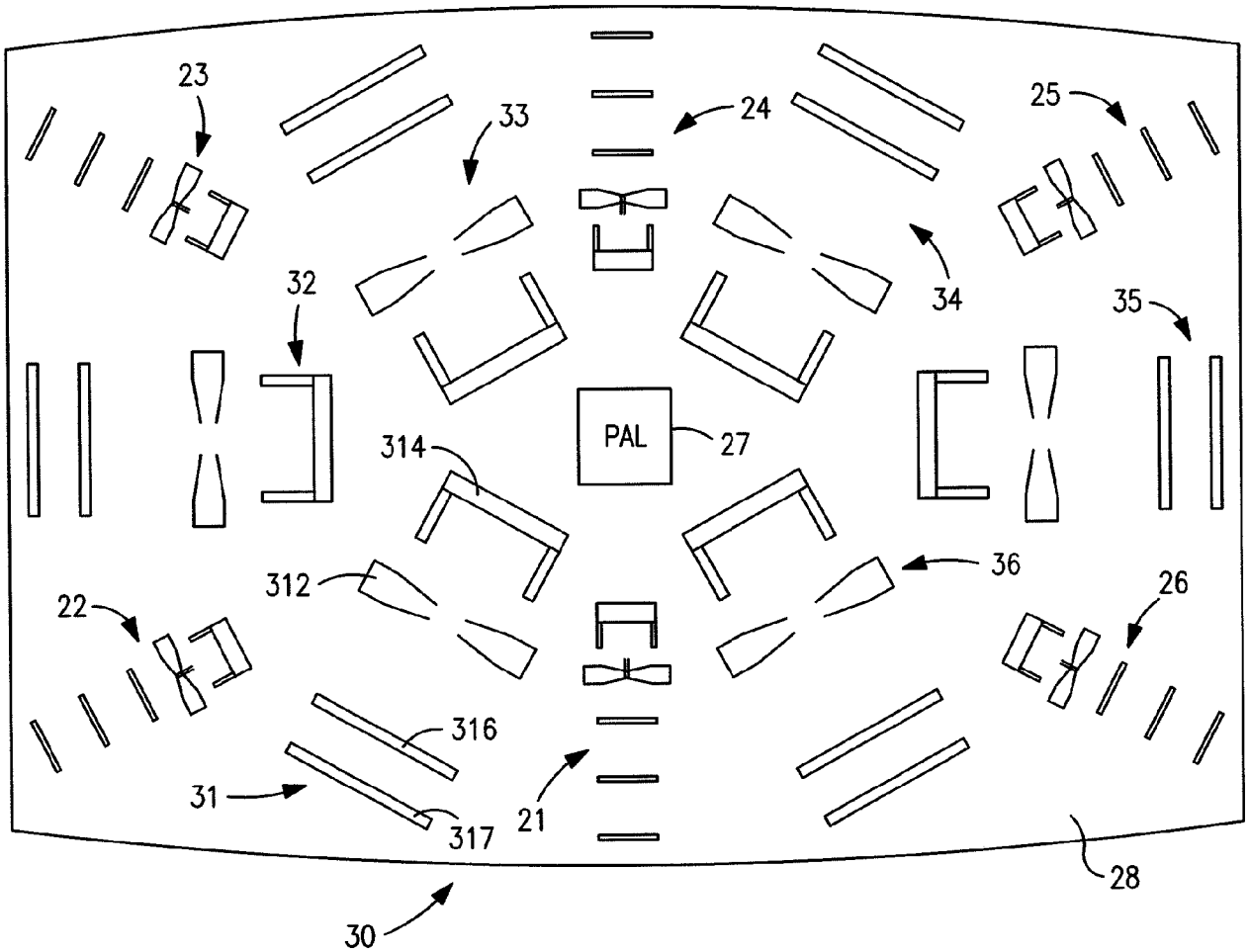
FIG. 3 is a schematic top view of a Yagi antenna array according to another preferred embodiment.

FIG. 3 is a schematic top view of a dual band, 12-Yagi antenna array 30 according to another preferred embodiment. The 5.0 GHz Yagi antennas 21, 22, 23, 24, 25, and 26 are moved outward from the center of the substrate 28, to make room for the larger 2.4 GHz Yagi antennas 31, 32, 33, 34, 35, and 36. Each 2.4 GHz Yagi antenna has a driven element, a reflector, and plural directors. Thus, Yagi antenna 31 has a driven element 312, a bent reflector 314, and two directors 316 and 317. The Yagi antennas 31, 32, 33, 34, 35, and 36 are printed on the top surface of the substrate 28 and are oriented in 60 degree increments about a center of the substrate 28, thus producing horizontally polarized beams. As the Yagi antennas 3*i* are interleaved with the Yagi antennas 2*i*, the array beam may be steered in 30 degree increments, 60 degree increments in each of the two bands. As in FIG. 2, the PAL 27 is preferably located in the center of the Yagi antennas, and switches the driven elements so as to steer the array beam.

Figure 4:
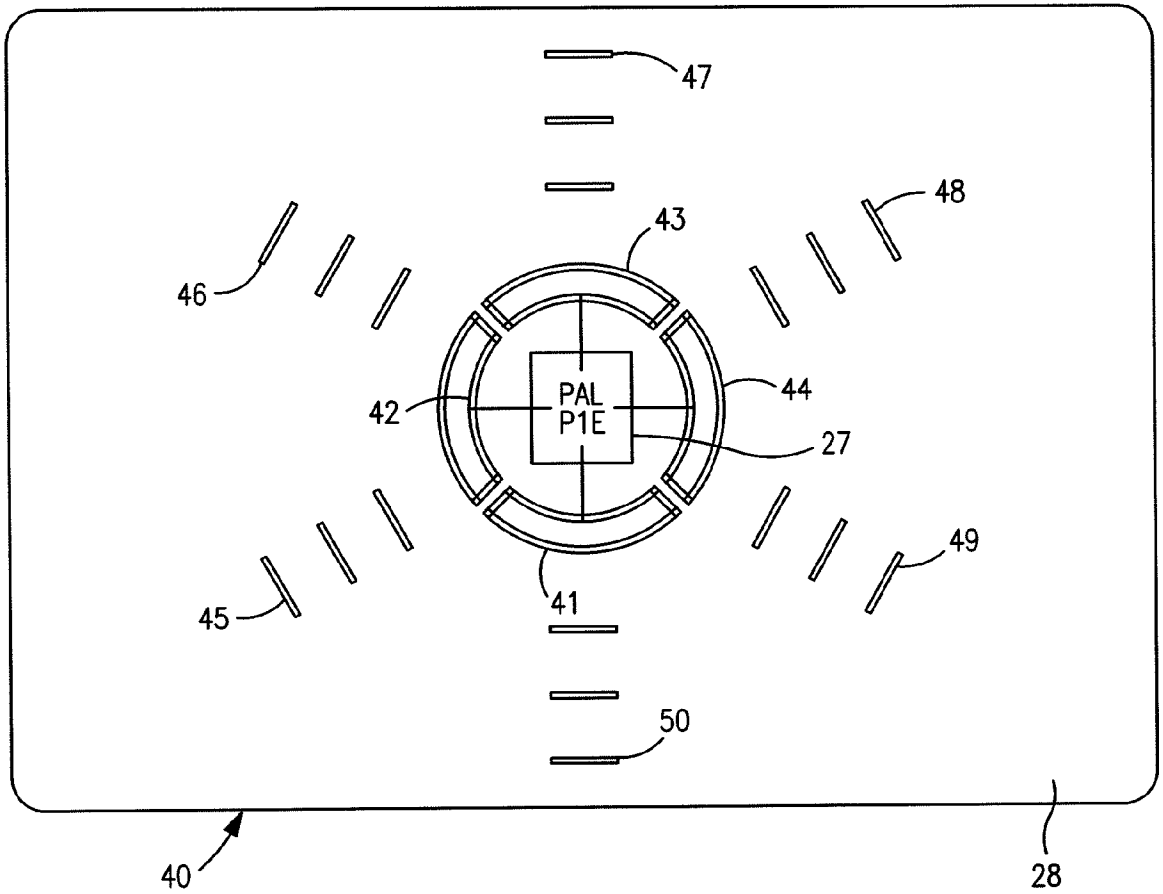
FIG. 4 is a schematic top view of a controllable antenna array according to yet another embodiment.

FIG. 4 is a schematic top view of a controllable antenna array 40 according to yet another embodiment. The array 40 may comprise features described in the above-referenced U.S. patent application Ser. No. 13/871,394, disposed in four arcuate ("loop") driven elements 41, 42, 43, 44, with directors 45, 46, 47, 48, 49, and 50 (each director preferably including three director elements). As with the above-described embodiments, the PAL 27 is centrally-disposed on the substrate 28 to perform switching of the driven elements, under control of the one or more processors 29. In this embodiment, the switching circuitry may comprise a plurality of pin diodes. Note that the array 40 may be disposed by itself on the substrate 28, or it may be combined with either of the arrays 20 and 30 described above, to provide additional communications channels in a MIMO system.

Figure 5A:
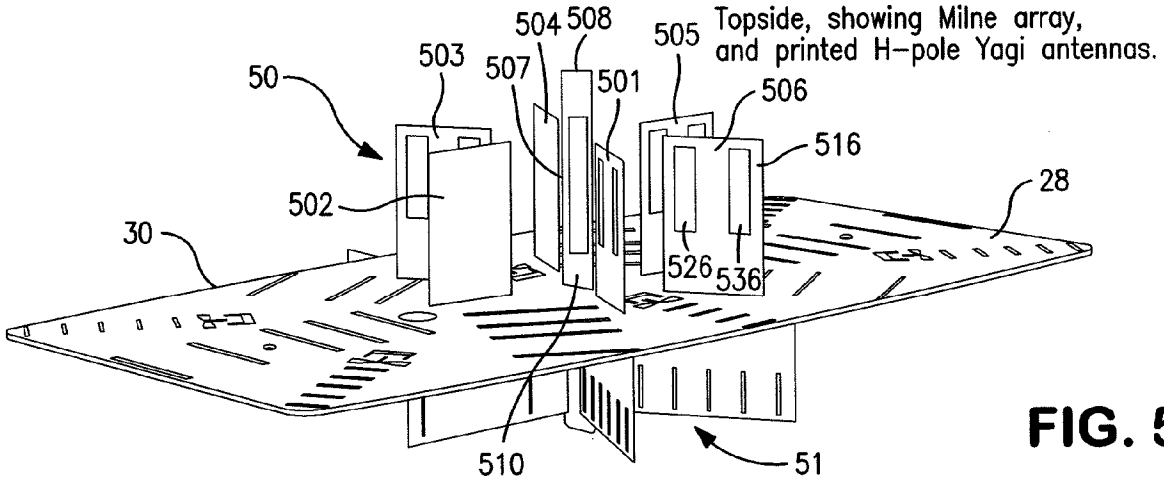
FIGS. 5(*a*) and 5(*b*) are, respectively, top and bottom perspective views according to another embodiment, incorporating the Yagi antenna array of FIG. 3.
Figure 5B:
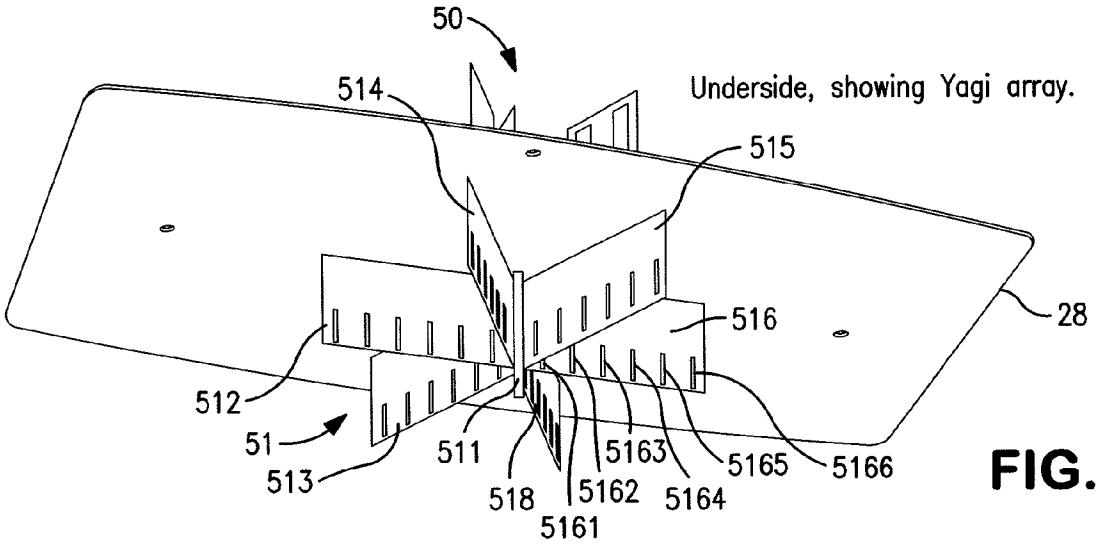

FIGS. 5(*a*) and 5(*b*) are, respectively, top and bottom perspective side views according to another embodiment, incorporating the Yagi antenna array of FIG. 3. The antenna array 50 features (i) the Yagi antenna array 30 disposed on a top surface of the substrate 28, (ii) a Milne antenna array 51 disposed vertically with respect to the top surface of the substrate 28, and (iii) a further Yagi antenna array 51 disposed vertically with respect to the bottom surface of the substrate 28. The Milne antenna array 50 preferably comprises vertically-disposed reflector arrays 501, 502, 503, 504, 505, and 506, each having 1-5 (preferably 2) reflectors. For example, reflector 506 comprises a PCB substrate 516 having rectangularly-shaped reflectors 526 and 536 printed thereon, each reflector having a vertically-extending longitudinal axis. One or more driven elements 507 (which may comprise one or more dipoles) are disposed on vertically-extending PCB substrate 508 disposed in the center of the array 50 and the substrate 28. Switching logic 510 is preferably mounted on the substrate 508 and may operate to control the switching of on or more of (i) the Yagi antenna array 30, (ii) the Milne antenna array 51, and (iii) the further Yagi antenna array 51.

The Milne array 50 preferably produces 2.4 GHz vertically-polarized beams which may be provided individually or in combination with the underlying horizontal Yagi antennas (which produce horizontally-polarized beams) to provide cross-polarized 2.4 GHz beams. Preferably, the reflector arrays 501, 502, 503, 504, 505, and 506 are disposed so as to be immediately adjacent but orthogonal with respect to the directors of the 2.4 GHZ Yagi antennas 31, 32, 33, 34, 35, and 36, as shown.

On the bottom surface of substrate 28 is disposed the further Yagi antenna array 51, which comprises six vertically-extending director arrays 511, 512, 513, 514, 515, and 516, each with 2-6 directors thereon. For example array 516 has vertically-disposed directors 5161, 5162, 5163, 5164, 5165, and 5166 printed thereon. The arrays are preferably printed on PCB substrates. Most preferably, the substrates of arrays 511, 512, 513, 514, 515, and 516 are integral with corresponding substrates of arrays 501, 502, 503, 504, 505, and 506, and extend through slots in the substrate 28, as shown. The driven elements and reflectors (if any) of the Yagi array 51 are disposed on a PCB substrate 518, which is disposed in the center of the array 51 and the substrate 28. Again, the substrate 518 may be integral with the substrate 508, via a slot in the substrate 28. Like the Milne array 50, the driven elements of the Yagi array 51 can be controlled with the switch element 510, or with a separate switch element (not shown) disposed on the substrate 518.

The Yagi array 51 preferably produces 5 GHz vertically-polarized beams which may be provided individually or in combination with the horizontally-disposed Yagi antennas (which produce horizontally-polarized beams) to provide cross-polarized beams. Preferably, the director arrays 511, 512, 513, 514, 515, and 516 are disposed so as to be immediately adjacent but orthogonal with respect to the directors of the Yagi antennas 31, 32, 33, 34, 35, and 36, as shown.

Figure 6:
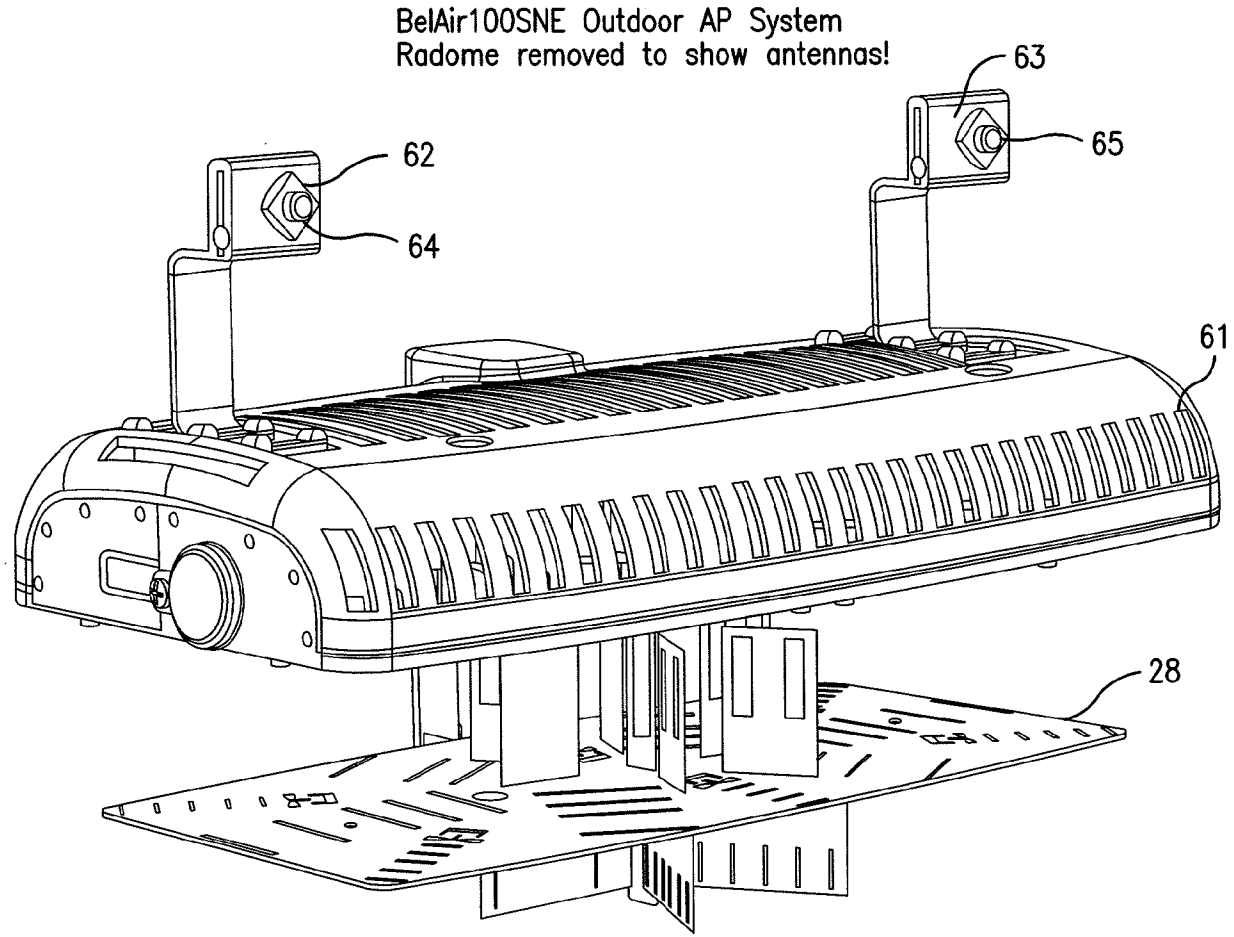
FIG. 6 Is a top perspective view of the FIG. 5 embodiment coupled to a strand-mounted housing.

FIG. 6 Is a top perspective view of the FIG. 5 embodiment coupled inside a strand-mounted housing, although only a top of the housing is shown. Coupling the antennas according to the present invention to a cable strand (i.e., coaxial cable wire, telephone wire, cable support metal wires, etc.) allows for great flexibility in placement and consequent excellent coverage. A city, neighborhood, or area with plural strand-mounted MIMO antenna arrays according to the present invention will be completely "wired." In FIG. 6, the substrate 28 is coupled to a housing bottom (not shown) via mounting hardware such as straps, screws, etc. Also in the housing bottom are the WiFi radios, transmitter/receivers, processors, memory, power-supply, coaxial-cable connections, splitters, etc., used in the AP. The housing top 61 preferably has two strand connection brackets 62 and 63, which are coupled to the strand by means of nuts/bolts 64 and 65.

In this manner, an innovative antenna system according to a preferred embodiments of the present invention has been designed and field-tested to verify functional operation.

While the foregoing detailed description has described particular preferred embodiments of this invention, it is to be understood that the above description is illustrative only and not limiting of the disclosed invention. While preferred embodiments of the present invention have been shown and described herein, it will be obvious to those skilled in the art that such embodiments are provided by way of example only. Numerous variations, changes, and substitutions will now occur to those skilled in the art without departing from the invention.

What is claimed is:

1. A Yagi antenna array, comprising:

a first driven element disposed on a first substrate and having a length;

a first reflector disposed on said first substrate on one side of the first driven element, said first reflector having a U-shape with (i) a first rectangular reflector base portion having a length, (ii) a first rectangular reflector first side portion having a length, and (iii) a first rectangular reflector second side portion having a length, wherein the length of the first reflector base portion is parallel to the length of the first driven element, wherein the first reflector first side portion is located at the end of the length of the first reflector base portion such that the length of the first reflector first side portion is perpendicular to the length of the first reflector base portion, and wherein the first reflector second side portion is located at an opposite end of the length of the first reflector base portion from the first reflector first side portion such that the length of the first reflector second side portion is perpendicular to the length of the first reflector base portion;

such that (i) the first reflector base portion length plus the first reflector first side portion length plus the first reflector second side portion length is greater than the length of the first driven element, and (ii) the first reflector base portion length is shorter than the length of the first driven element;

a plurality of first directors disposed on said first substrate on a side of said first driven element which is opposite a side on which the first reflector is disposed;

a second driven element disposed on said first substrate and (i) co-planar but (ii) non-linear, with respect to the first driven element, the second driven element having a length;

a second reflector disposed on said first substrate on one side of the second driven element, said second reflector having a U-shape with (i) a second rectangular reflector base portion having a length, (ii) a second rectangular reflector first side portion having a length, and (iii) a second rectangular reflector second side portion having a length, wherein the length of the second reflector base portion is parallel to the length of the first driven element, wherein the second reflector first side portion is located at the end of the length of the second reflector base portion such that the length of the second reflector first side portion is perpendicular to the length of the second reflector base portion, and wherein the second reflector second side portion is located at an opposite end of the length of the second reflector base portion from the second reflector first side portion such that the length of the second reflector second side portion is perpendicular to the length of the second reflector base portion;

such that (i) the second reflector base portion length plus the second reflector first side portion length plus the second reflector second side portion length is greater than the length of the second driven element, and (ii) the second reflector base portion length is shorter than the length of the second driven element; and a plurality of second directors disposed on said first substrate on a side of said second driven element which is opposite a side on which the second reflector is disposed.

2. The antenna array according to claim 1, further comprising (i) third, fourth, fifth, and sixth driven elements, (ii) corresponding third, fourth, fifth, and sixth reflectors, and (iii) corresponding third, fourth, fifth, and sixth pluralities of directors, all disposed on said first substrate and correspondingly arranged as set forth in claim 1.

3. The antenna array according to claim 2, further comprising switch structure disposed on said first substrate adjacent the six driven elements and configured to cause the antenna array beam to be steered in 60 degree steps.

4. The antenna array according to claim 2, further comprising (i) seventh, eighth, ninth, tenth, eleventh, and twelfth driven elements, (ii) corresponding seventh, eighth, ninth, tenth, eleventh, and twelfth reflectors, and (iii) corresponding seventh, eighth, ninth, tenth, eleventh, and twelfth pluralities of directors, all disposed on said first substrate and correspondingly arranged as set forth in claim 1.

5. The antenna array according to claim 4, further comprising switch structure disposed on said first substrate adjacent the twelve driven elements and configured to cause the antenna array beam to be steered in 30 degree steps.

6. The antenna array according to claim 1, further comprising:

a third driven element disposed on a second substrate which is orthogonally disposed with respect to said first substrate, the third driven element having a length;

a third reflector disposed on said second substrate on one side of the third driven element, said third reflector having a U-shape with (i) a third rectangular reflector base portion having a length, (ii) a third rectangular reflector first side portion having a length, and (iii) a third rectangular reflector second side portion having a length, such that (i) the third reflector base portion length plus the third reflector first side portion length plus the third reflector second side portion length is greater than the length of the third driven element, and (ii) the third reflector base portion length is shorter than the length of the third driven element;

a plurality of third directors disposed on said second substrate on a side of said third driven element which is opposite a side on which the third reflector is disposed;

a fourth driven element disposed on a third substrate which is orthogonally disposed with respect to said first substrate at an angle with respect to said second substrate, the fourth driven element having a length;

a fourth reflector disposed on said third substrate on one side of the fourth driven element, said fourth reflector having a U-shape with (i) a fourth rectangular reflector base portion having a length, (ii) a fourth rectangular reflector first side portion having a length, and (iii) a fourth rectangular reflector second side portion having a length, such that (i) the fourth reflector base portion length plus the fourth reflector first side portion length plus the fourth reflector second side portion length is greater than the length of the fourth driven element, and (ii) the fourth reflector base portion length is shorter than the length of the fourth driven element; and a plurality of fourth directors disposed on said third substrate on a side of said fourth driven element which is opposite a side on which the fourth reflector is disposed.

7. The antenna array according to claim 6, wherein the plurality of third directors is disposed with respect to said plurality of first directors so as to provide a cross polarized beam.

8. The antenna array according to claim 6, wherein the first plurality of directors and the second plurality of directors are disposed on a top surface of said substrate, and wherein the second substrate and the third substrate are disposed on a bottom surface of said first substrate.

9. The antenna array according to claim 8, further comprising a fifth substrate and a fifth substrate which are orthogonally disposed with respect to said first substrate on the top surface thereof.

10. The antenna array according to claim 8, further comprising:

a fifth driven element disposed on a sixth substrate which is orthogonally disposed with respect to said first substrate on the top surface thereof and is disposed in a central portion of said first substrate;

at least one fifth director disposed on said fourth substrate; and at least one sixth director disposed on said fifth substrate.

11. The antenna array according to claim 6, wherein the second substrate is angled at substantially 60 degrees with respect to said third substrate.

12. The antenna array according to claim 6, wherein the first driven element, the first reflector, and the first plurality of directors comprise a first Yagi antenna operating substantially at the 2.4 GHz band, wherein the second driven element, the second reflector, and the second plurality of directors comprise a second Yagi antenna operating substantially at the 5 GHz band, wherein the third driven element, the third reflector, and the third plurality of directors comprise a third Yagi antenna operating substantially at the 5 GHz band, and wherein the fourth driven element, the fourth reflector, and the fourth plurality of directors comprise a fourth Yagi antenna operating substantially at the 5 GHz band.

13. The antenna array according to claim 6, wherein the plurality of third directors is disposed with respect to said plurality of second directors so as to provide a cross polarized beam substantially at the 5 GHz band.

14. A printed Yagi antenna array comprising a horizontal printed circuit board substrate; and first, second, third, fourth, fifth, and sixth Yagi antennas printed on the horizontal substrate, each Yagi antenna oriented with respect to its neighboring Yagi antennas such that their respective beams diverge in a range of about 30 degrees to about 60 degrees, each Yagi antenna including:

a driven element having a length;

a reflector disposed on one side of the driven element, the reflector having a U-shape with (i) a rectangular reflector base portion having a length, (ii) a rectangular reflector first side portion having a length, and (iii) a rectangular reflector second side portion having a length, wherein the length of the reflector base portion is parallel to the length of the driven element, wherein the reflector first side portion is located at the end of the length of the reflector base portion such that the length of the reflector first side portion is perpendicular to the length of the reflector base portion, and wherein the reflector second side portion is located at an opposite end of the length of the reflector base portion from the reflector first side portion such that the length of the reflector second side portion is perpendicular to the length of the reflector base portion;

such that (i) the reflector base portion length plus the reflector first side portion length plus the reflector second side portion is greater than the length of the driven element, and (ii) the reflector base portion length is shorter than the length of the driven element; and a plurality of directors disposed on a side of the driven element which is opposite a side on which the reflector is disposed.

15. The printed Yagi antenna array according to claim 14, wherein first plural Yagi antennas operate in substantially the 5 GHz range, and wherein second plural Yagi antennas operate in substantially the 2.4 GHz range.

16. The printed Yagi antenna array according to claim 14, further comprising plural first vertical substrates disposed on one side of the horizontal substrate and orthogonally arranged with respect thereto, each of the plural first vertical substrates having a Yagi antenna printed thereon, at least one Yagi antenna that is disposed on one of the plural first vertical substrates being disposed with respect to at least one of said first, second, third, fourth, fifth, and sixth Yagi antennas printed on the horizontal substrate such that a cross-polarized beam is provided.

17. The printed Yagi antenna array according to claim 16, wherein each Yagi antenna that is disposed on the plural first vertical substrates has a driven element, a reflector, and plural directors arranged as set forth in claim 14.

18. The printed Yagi antenna array according to claim 16, further comprising:

a second vertical substrate disposed on another side of the horizontal substrate and orthogonally arranged with respect thereto a driven λ/4 monopole being disposed on said second vertical substrate;

plural fourth vertical substrates disposed on said another side of the horizontal substrate, orthogonally arranged with respect thereto, and circularly arrayed about said second vertical substrate, each plural fourth vertical substrate having at least one parasitic element thereon, so that the plural fourth vertical substrates form, with said driven λ/4 monopole, a Milne antenna array on said another side of the horizontal substrate; and control circuitry disposed on said second vertical substrate and coupled to (i) said driven λ/4 monopole, (ii) the driven elements of the Yagi antennas that are disposed on the plural first vertical substrates, and (iii) the driven elements of the first, second, third, fourth, fifth, and sixth Yagi antennas printed on the horizontal substrate, so as to control the directivity of one or more beams of the printed Yagi antenna array.

19. A Yagi antenna, comprising:

a driven element having a length;

a director disposed on a side of the driven element;

a reflector disposed on one side of the driven element, the reflector having a U-shape with (i) a rectangular reflector base portion having a length, (ii) a rectangular reflector first side portion having a length, and (iii) a rectangular reflector second side portion having a length, wherein the length of the reflector base portion is parallel to the length of the driven element, wherein the reflector first side portion is located at the end of the length of the reflector base portion such that the length of the reflector first side portion is perpendicular to the length of the reflector base portion, and wherein the reflector second side portion is located at an opposite end of the length of the reflector base portion from the reflector first side portion such that the length of the reflector second side portion is perpendicular to the length of the reflector base portion;

such that (i) the reflector base portion length plus the reflector first side portion length plus the reflector second side portion length is greater than the length of the driven element, and (ii) the reflector base portion length is shorter than the length of the driven element; and a strand-mounted housing enclosing said Yagi antenna.

20. A Yagi antenna array, comprising:

a substrate;

a first Yagi antenna including:

a first driven element disposed on said substrate, said first driven element having a length;

a first director disposed on said substrate on a side of the first driven element; and a first reflector disposed on said substrate on a side of said first driven element which is opposite a side on which the director is disposed, said first reflector having a U-shape with (i) a first rectangular reflector base portion having a length, (ii) a first rectangular reflector first side portion having a length, and (iii) a first rectangular reflector second side portion having a length, wherein the length of the first reflector base portion is parallel to the length of the first driven element, wherein the first reflector first side portion is located at the end of the length of the first reflector base portion such that the length of the first reflector first side portion is perpendicular to the length of the first reflector base portion, and wherein the first reflector second side portion is located at an opposite end of the length of the first reflector base portion from the first reflector first side portion such that the length of the first reflector second side portion is perpendicular to the length of the first reflector base portion;

such that (i) the first reflector base portion length plus the first reflector first side portion length plus the first reflector second side portion length is greater than the length of the first driven element, and (ii) the first reflector base portion length is shorter than the length of the first driven element; and a second Yagi antenna including:

a second driven element disposed on said substrate said second driven element having a length;

a second director disposed on said substrate on another side of the second driven element; and a second reflector disposed on said substrate on a side of said second driven element which is opposite a side on which the second director is disposed, said second reflector having a U-shape with (i) a second rectangular reflector base portion having a length, (ii) a second rectangular reflector first side portion having a length, and (iii) a second rectangular reflector second side portion having a length, wherein the length of the second reflector base portion is parallel to the length of the first driven element, wherein the second reflector first side portion is located at the end of the length of the second reflector base portion such that the length of the second reflector first side portion is perpendicular to the length of the second reflector base portion, and wherein the second reflector second side portion is located at an opposite end of the length of the second reflector base portion from the second reflector first side portion such that the length of the second reflector second side portion is perpendicular to the length of the second reflector base portion;

such that (i) the second reflector base portion length plus the second reflector first side portion length plus the second reflector second side portion length is greater than the length of the second driven element, and (ii) the second reflector base portion length is shorter than the length of the second driven element, wherein the beam of the first Yagi antenna is directed along a different azimuth than the beam of the second Yagi antenna.

21. A method of switching antenna beams in a circularly-oriented, six Yagi antenna array disposed on a printed circuit board, each Yagi antenna having a driven element, a reflector, and plural directors, comprising the steps of:

operating a control circuit so as to activate a first driven element to cause a first beam to be (i) reflected by a first reflector having a U-shape with (i) a first rectangular reflector base portion having a length, (ii) a first rectangular reflector first side portion having a length, and (iii) a first rectangular reflector second side portion having a length, wherein the length of the first reflector base portion is parallel to the length of the first driven element, wherein the first reflector first side portion is located at the end of the length of the first reflector base portion such that the length of the first reflector first side portion is perpendicular to the length of the first reflector base portion, and wherein the first reflector second side portion is located at an opposite end of the length of the first reflector base portion from the first reflector first side portion such that the length of the first reflector second side portion is perpendicular to the length of the first reflector base portion, such that (i) the first reflector base portion length plus the first reflector first side portion length plus the first reflector second side portion length is greater than a length of the first driven element, and (ii) the first reflector base portion length is shorter than the length of the first driven element, and (ii) directed by plural first directors in a first direction; and operating the control circuit so as to inactivate the first driven element;

operating the control circuit so as to activate a second driven element to cause a second beam to be (i) reflected by a second reflector having a U-shape with (i) a second rectangular reflector base portion having a length, (ii) a second rectangular reflector first side portion having a length, and (iii) a second rectangular reflector second side portion having a length, wherein the length of the second reflector base portion is parallel to the length of the first driven element, wherein the second reflector first side portion is located at the end of the length of the second reflector base portion such that the length of the second reflector first side portion is perpendicular to the length of the second reflector base portion, and wherein the second reflector second side portion is located at an opposite end of the length of the second reflector base portion from the second reflector first side portion such that the length of the second reflector second side portion is perpendicular to the length of the second reflector base portion, such that (i) the second reflector base portion length plus the second reflector first side portion length plus the second reflector second side portion length is greater than a length of the second driven element, and (ii) the second reflector base portion length is shorter than the length of the second driven element, and (ii) directed by plural second directors in a second direction which is at least 30 degrees divergent from the first direction.

* * * * *

UNITED STATES PATENT AND TRADEMARK OFFICE

CERTIFICATE OF CORRECTION

PATENT NO. : 9,246,235 B2
APPLICATION NO. : 13/661373
DATED : January 26, 2016
INVENTOR(S) : Smith et al.

It is certified that error appears in the above-identified patent and that said Letters Patent is hereby corrected as shown below:

In the Specification

In Column 8, Line 52, delete "on or more" and insert -- one or more --, therefor.

Signed and Sealed this
Thirty-first Day of May, 2016

Michelle K. Lee

Michelle K. Lee
*Director of the United States Patent and Trademark Office*